US011504829B2

(12) United States Patent
Pannone

(10) Patent No.: US 11,504,829 B2
(45) Date of Patent: Nov. 22, 2022

(54) POWERED SOCKET WRENCH ASSEMBLY

(71) Applicant: Joseph Pannone, Babylon, NY (US)

(72) Inventor: Joseph Pannone, Babylon, NY (US)

( * ) Notice: Subject to any disclaimer, the term of this patent is extended or adjusted under 35 U.S.C. 154(b) by 369 days.

(21) Appl. No.: 16/824,208

(22) Filed: Mar. 19, 2020

(65) Prior Publication Data

US 2021/0291328 A1 Sep. 23, 2021

(51) Int. Cl.

| | |
|---|---|
| ***B25B 21/00*** | (2006.01) |
| ***B25F 5/02*** | (2006.01) |
| ***B25B 23/00*** | (2006.01) |

(52) U.S. Cl.

CPC ..... *B25B 21/002* (2013.01); *B25B 23/0035* (2013.01); *B25F 5/02* (2013.01)

(58) Field of Classification Search

CPC .... B25B 21/0025; B25B 23/0035; B25F 5/02
See application file for complete search history.

(56) References Cited

U.S. PATENT DOCUMENTS

| | | | | |
|---|---|---|---|---|
| 2,711,110 | A | 6/1955 | Brame | |
| 4,322,989 | A | 4/1982 | Garolis | |
| 6,364,033 | B1 * | 4/2002 | Hung | B25F 5/021 173/217 |
| 7,089,827 | B2 * | 8/2006 | Wexler | B25B 13/481 81/169 |
| D527,592 | S | 9/2006 | Hayakawa | |
| 7,500,412 | B1 * | 3/2009 | Maciejewski | B25B 21/002 74/424.71 |
| 7,571,668 | B1 * | 8/2009 | Chang | B25B 13/481 81/57.29 |
| 8,276,685 | B2 * | 10/2012 | Hozumi | B25B 21/00 173/39 |
| 9,149,916 | B2 * | 10/2015 | Kiser | B25B 17/00 |
| 9,266,178 | B2 * | 2/2016 | Eshleman | B25F 5/02 |
| 9,308,638 | B2 * | 4/2016 | Kondo | B25F 5/02 |
| 9,475,180 | B2 * | 10/2016 | Eshleman | B25B 23/14 |
| 9,616,556 | B2 | 4/2017 | Kauffman | |
| 9,669,524 | B1 * | 6/2017 | Bowling | B25B 23/0035 |
| 10,160,049 | B2 * | 12/2018 | Eshleman | B23B 51/009 |
| 10,377,022 | B2 * | 8/2019 | Saitou | B25B 21/00 |
| 10,507,569 | B1 * | 12/2019 | Marotta | B25F 5/02 |
| 2010/0263494 | A1 * | 10/2010 | Badiali | B23Q 5/045 81/57 |
| 2012/0266709 | A1 * | 10/2012 | Wang | B25F 3/00 74/417 |

(Continued)

FOREIGN PATENT DOCUMENTS

| | | | | |
|---|---|---|---|---|
| CN | 107825343 A | * | 3/2018 | B25B 21/002 |
| CN | 111390803 A | * | 7/2020 | B25B 21/002 |
| WO | WO2017187388 | | 11/2017 | |

*Primary Examiner* — David B. Thomas

(57) ABSTRACT

A powered socket wrench assembly includes a power tool that has a back end and a front end. The power tool is elongated along a longitudinal axis extending between the back end and the front end thereby facilitating the power tool to be inserted into a hard to reach area. Additionally, the power tool includes a chuck that is rotated in a first direction or a second direction when the power tool is turned on. A drive unit is insertable into the chuck on the power tool thereby facilitating the power tool to rotate the drive unit when the power tool is turned on. The drive unit includes a socket that is rotatable about an axis oriented perpendicular to the longitudinal axis of the power tool when the power tool is turned on.

8 Claims, 4 Drawing Sheets

(56) References Cited

U.S. PATENT DOCUMENTS

| | | | |
|---|---|---|---|
| 2016/0167207 | A1 | 6/2016 | Badiali |
| 2018/0354103 | A1 | 12/2018 | Doroslovac |
| 2019/0134791 | A1 | 5/2019 | LaCosta |

* cited by examiner

POWERED SOCKET WRENCH ASSEMBLY

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to powered wrench devices and more particularly pertains to a new powered wrench device for tightening or loosening a threaded fastener in a tight location.

(2) Description of Related Art Including Information Disclosed Under 37 CFR 1.97 and 1.98

The prior art relates to powered wrench devices. The prior art discloses a powered open end wrench for loosening or tightening threaded fasteners. The prior art discloses a powered socket driver that includes a socket that is offset from a drive shaft. The prior art discloses a powered wrench that includes a pair of cams that either engage or release a fastener. Additionally, the prior art discloses a socket wrench device that has a drive input for receiving an output shaft of a power tool.

(h) BRIEF SUMMARY OF THE INVENTION

An embodiment of the disclosure meets the needs presented above by generally comprising a power tool that has a back end and a front end. The power tool is elongated along a longitudinal axis extending between the back end and the front end thereby facilitating the power tool to be inserted into a hard to reach area. Additionally, the power tool includes a chuck that is rotated in a first direction or a second direction when the power tool is turned on. A drive unit is insertable into the chuck on the power tool thereby facilitating the power tool to rotate the drive unit when the power tool is turned on. The drive unit includes a socket that is rotatable about an axis oriented perpendicular to the longitudinal axis of the power tool when the power tool is turned on.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
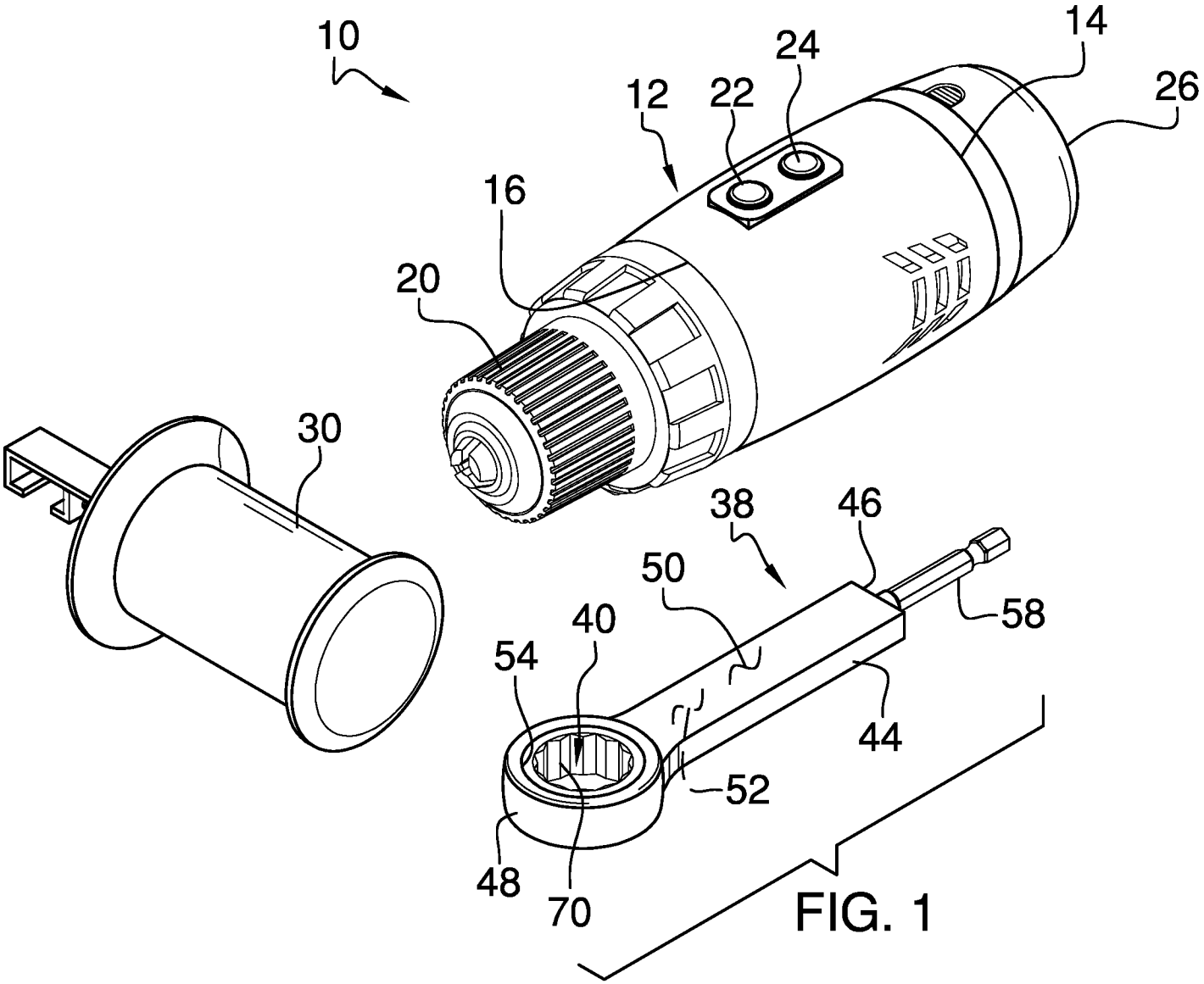
FIG. 1 is a perspective view of a powered socket wrench assembly according to an embodiment of the disclosure.
Figure 2:
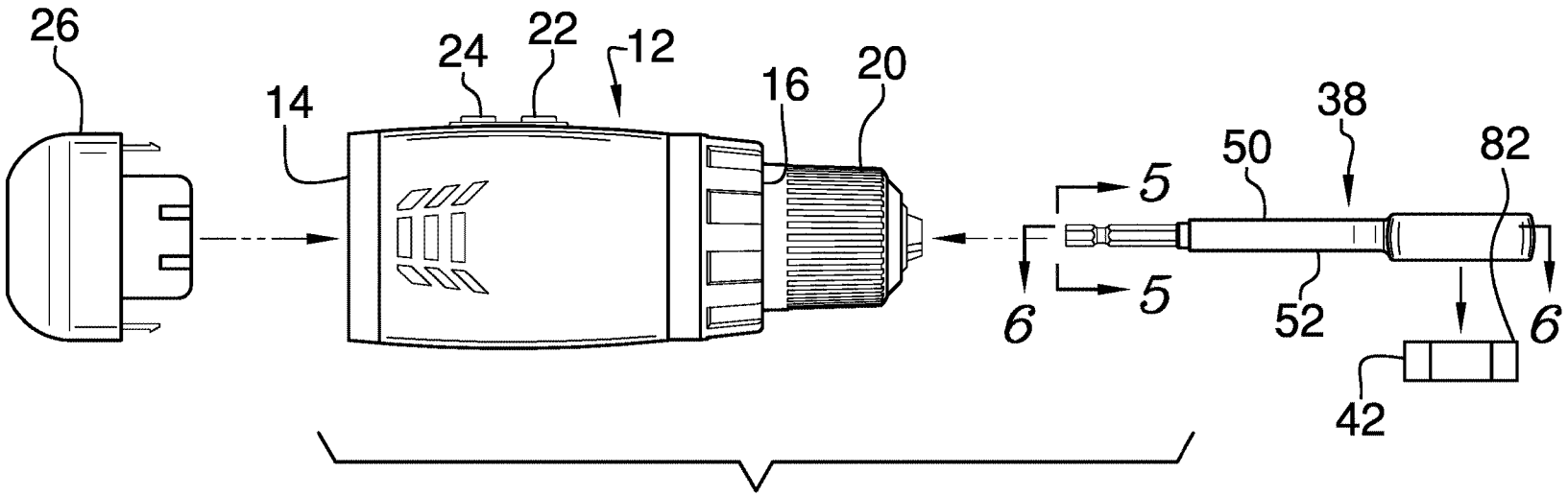
FIG. 2 is a top exploded view of an embodiment of the disclosure.
Figure 3:
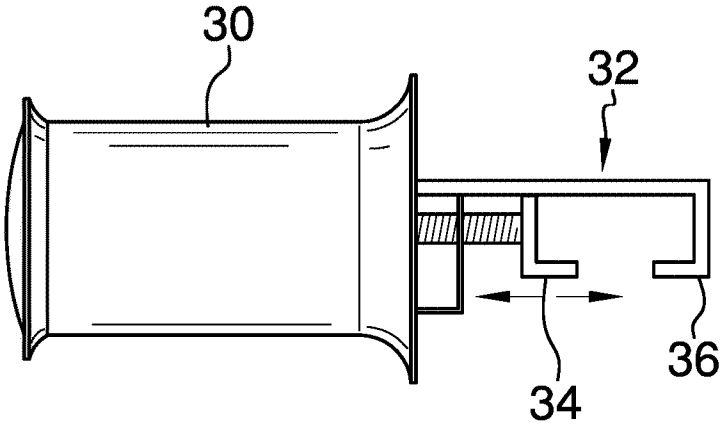
FIG. 3 is a perspective view of a handle of an embodiment of the disclosure.
Figure 4:
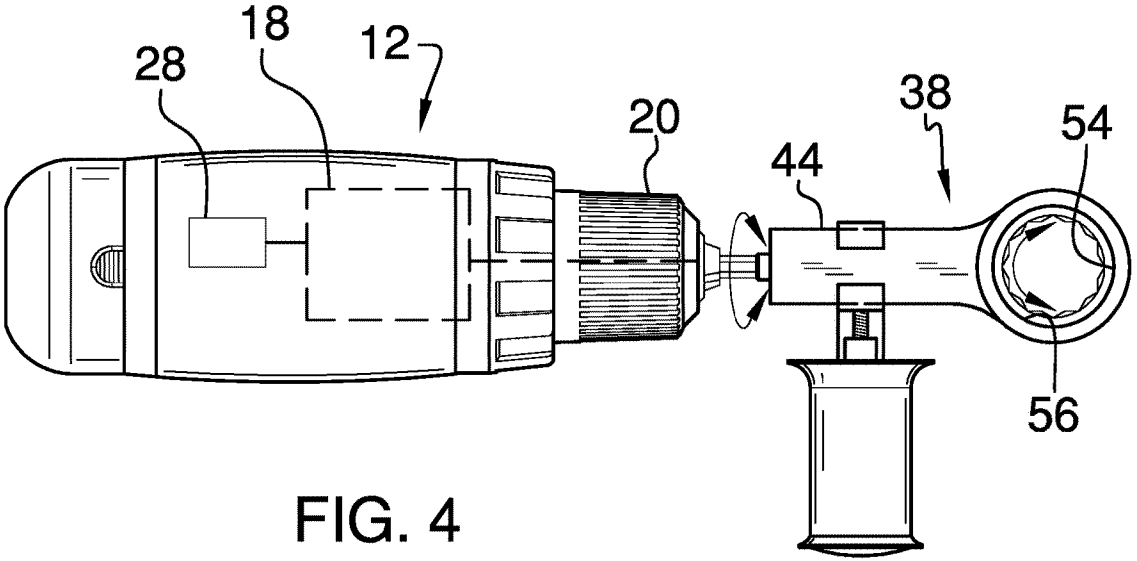
FIG. 4 is a top view of an embodiment of the disclosure.
Figure 5:
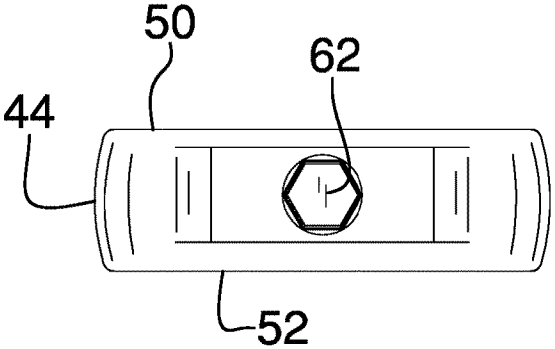
FIG. 5 is a cross sectional view taken along line 5-5 of FIG. 2 of an embodiment of the disclosure.
Figure 6:
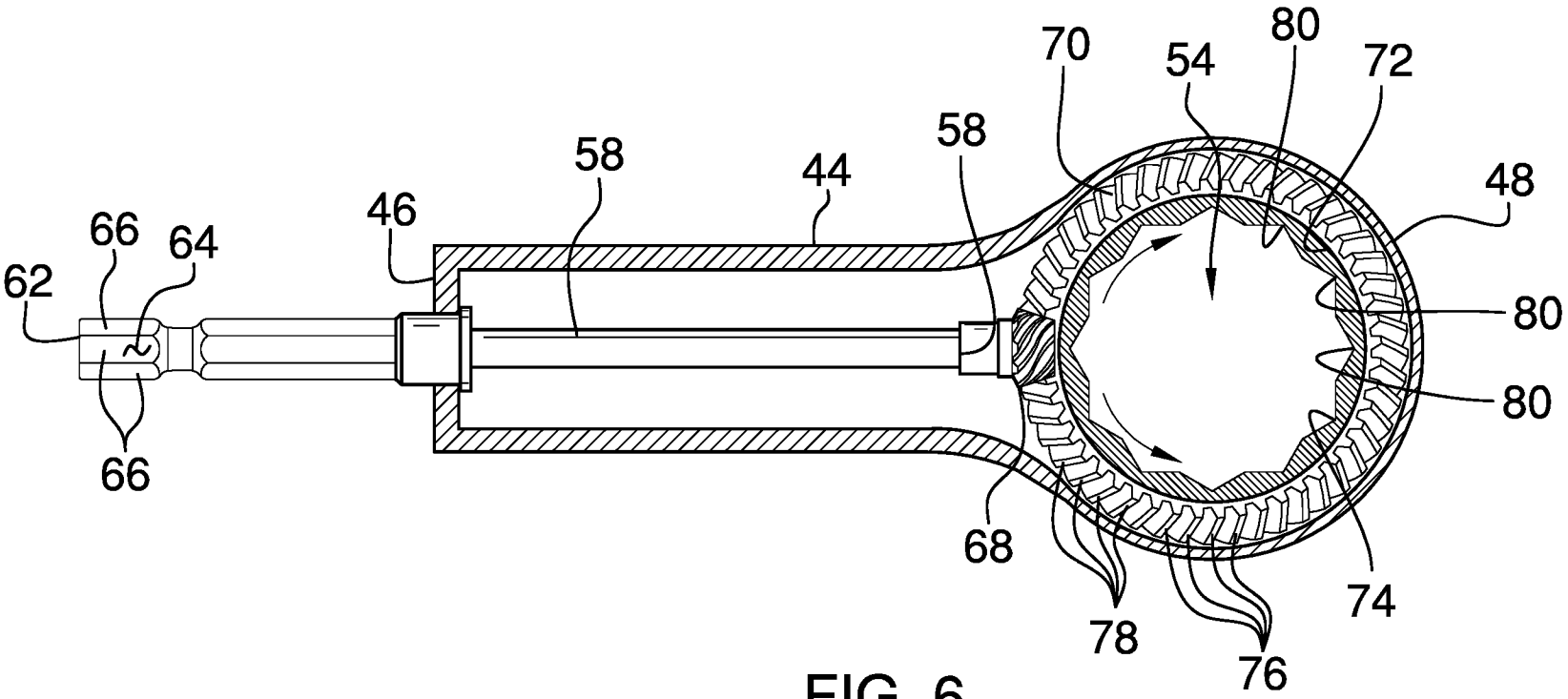
FIG. 6 is a cross sectional view taken along line 6-6 of FIG. 2 of an embodiment of the disclosure.

With reference now to the drawings, and in particular to FIGS. 1 through 6 thereof, a new powered wrench device embodying the principles and concepts of an embodiment of the disclosure and generally designated by the reference numeral 10 will be described.

As best illustrated in FIGS. 1 through 6, the powered socket wrench assembly 10 generally comprises a power tool 12 that has a back end 14 and a front end 16. The power tool 12 is elongated along a longitudinal axis extending between the back end 14 and the front end 16. In this way the power tool 12 can be inserted into a hard to reach area that would be inaccessible to a power tool, such a drill, which has a handle extending away from a body.

The power tool 12 includes a motor 18, a chuck 20 that is rotatably coupled to the motor 18, a forward switch 22 and a reverse switch 24. Each of the forward switch 22 and the reverse switch 24 are electrically coupled to the motor 18. Moreover, the motor 18 rotates in a first direction when the forward switch 22 is engaged and the motor 18 is turned on and the motor 18 rotates in a second direction when the reverse switch 24 is engaged and the motor 18 is turned on. The motor 18 may comprise an electric motor or the like. Additionally, the power tool 12 may include a rechargeable battery 26 for supplying electrical power to the motor 18 and a trigger 28 for turning on the motor 18.

A drive unit 38 is insertable into the chuck 20 on the power tool 12 thereby facilitating the power tool 12 to rotate the drive unit 38 when the power tool 12 is turned on. The drive unit 38 includes a socket 40 that is rotatable about an axis oriented perpendicular to the longitudinal axis of the power tool 12 when the power tool 12 is turned on. In this way the drive unit 38 can tighten or loosen a threaded fastener 42, such as a bolt or a nut, while having the power tool 12 oriented perpendicular to a longitudinal axis of the threaded fastener 42.

The drive unit 38 comprises a housing 44 that has a rear end 46, a front end 48, a top surface 50 and a bottom surface 52. The housing 44 curves outwardly adjacent to the front end 16 such that the front end 16 has a circular cross section taken along a line extending through the top surface 50 and the bottom surface 52. The housing 44 has an opening 54 extending through the top surface 50 and the bottom surface 52 and the opening 54 is positioned adjacent to the front end 16. Additionally, the opening 54 has a bounding surface 56 that is continuously arcuate about a center point of the opening 54 such that the opening 54 has a circular shape.

The drive unit 38 includes a drive shaft 58 that has a drive end 60 and a coupling end 62. The drive shaft 58 extends into the housing 44 having the coupling end 62 being exposed and having the drive end 60 being positioned within the housing 44. The coupling end 62 has an outer surface 64 and the outer surface 64 has a plurality of intersecting sides 66 thereby facilitating the chuck 20 to grip the drive shaft 58 when the coupling end 62 is inserted into the chuck 20. Moreover, the chuck 20 rotates the drive shaft 58 in the first direction or the second direction when the motor 18 is turned on.

The drive unit 38 includes a drive gear 68 that is coupled to the drive end 60 of the drive shaft 58. The drive gear 68 may be a worm gear or other similar drive gear that transfers rotational torque at a right angle. The drive unit 38 includes a ring gear 70 that is rotatably positioned within the housing 44. The ring gear 70 has a top surface 72 and an inwardly facing surface 74, and the top surface 72 of the ring gear 68 has a plurality of grooves 76 therein to define a plurality of teeth 78. Additionally, the drive gear 68 engages the teeth 78 on the top surface 72 of the ring gear 68.

The ring gear 70 surrounds the opening 54 in the housing 44 having the inwardly facing surface 74 being exposed in the opening 54. In this way the ring can engage the threaded fastener 42. Moreover, the inwardly facing surface 74 of the ring gear 70 has a plurality of indentations 80 therein to engage respective sides of a head 82 on the threaded fastener 42. The ring gear 70 is rotated about an axis that is oriented perpendicular to the longitudinal axis of the power tool 12. In this way the drive unit 38 facilitates the threaded fastener 42 to be loosened or tightened in a tight space.

A handle 30 is releasably attachable to the power tool 12 to enhance gripping the power tool 12. The handle 30 includes an engagement 32 that is movably coupled to the handle 30. Additionally, the engagement 32 comprises a first jaw 34 that that is slidable toward or away from a second jaw 36. The engagement 32 can be clamped onto an engagement point on the power tool 12 thereby facilitating the handle 30 to extend along an axis oriented perpendicular to the longitudinal axis of the power tool 12.

In use, the drive shaft 58 of the drive unit 38 is tightened in the chuck 20 on the power tool 12. The forward switch 22 is engaged and the ring gear 70 is positioned around the threaded fastener 42 to be loosened. The motor 18 is turned on and the ring gear 70 rotates the threaded fastener 42 in a clockwise direction for tightening the threaded fastener 42. The reverse switch 24 is engaged and the motor 18 is turned on for loosening the threaded fastener 42. Thus, the ring gear 70 rotates the threaded fastener 42 in a counterclockwise direction loosening the threaded fastener 42. In this way the power tool 12 and drive unit 38 can be employed in the convention of a socket wrench, a box end wrench or an open end wrench.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A powered socket wrench assembly being configured to apply torque to a threaded fastener for tightening or loosening the threaded fastener, said assembly comprising:

a power tool having a back end and a front end, said power tool being elongated along a longitudinal axis extending between said back end and said front end wherein said power tool is configured to be inserted into a hard to reach area, said power tool including a chuck that rotates in a first direction or a second direction when said power tool is turned on; and a drive unit being insertable into said chuck on said power tool thereby facilitating said power tool to rotate said drive unit when said power tool is turned on, said drive unit including a socket being rotatable about an axis being oriented perpendicular to said longitudinal axis of said power tool when said power tool is turned on;

a handle being releasably attachable to said drive unit wherein said handle is configured to enhance gripping said drive unit; and wherein said handle includes an engagement being movably coupled to said handle, said engagement comprising a first jaw that is slidable toward or away from a second jaw, said engagement releasably engaging said drive unit thereby facilitating said handle to extend along an axis being oriented perpendicular to said longitudinal axis of said power tool when said drive unit is engaged in said chuck.

2. The assembly according to claim 1, wherein said power tool includes a motor, a forward switch and a reverse switch, said chuck being rotatably coupled to said motor, said motor rotating in a first direction when said forward switch is engaged and said motor is turned on, said motor rotating in a second direction when said reverse switch is engaged and said motor is turned on.

3. A powered socket wrench assembly being configured to apply torque to a threaded fastener for tightening or loosening the threaded fastener, said assembly comprising:

a power tool having a back end and a front end, said power tool being elongated along a longitudinal axis extending between said back end and said front end wherein said power tool is configured to be inserted into a hard to reach area, said power tool including a chuck that rotates in a first direction or a second direction when said power tool is turned on; and a drive unit being insertable into said chuck on said power tool thereby facilitating said power tool to rotate said drive unit when said power tool is turned on, said drive unit including a socket being rotatable about an axis being oriented perpendicular to said longitudinal axis of said power tool when said power tool is turned on;

a handle being releasably attachable to said drive unit wherein said handle is configured to enhance gripping said drive unit; and wherein said drive unit comprises a housing having a rear end, a front end, a top surface and a bottom surface, said housing curving outwardly adjacent to said front end such that said front end has a circular cross section taken along a line extending through said top surface and said bottom surface, said housing having an opening extending through said top surface and said bottom surface, said opening being positioned adjacent to said front end, said opening having a bounding surface being continuously arcuate about a center point of said opening such that said opening has a circular shape.

4. The assembly according to claim 3, Wherein said drive unit includes a drive shaft having a drive end and a coupling end, said drive shaft extending into said housing having said coupling end being exposed and having said drive end being positioned within said housing.

5. The assembly according to claim 4, wherein said coupling end has an outer surface, said outer surface having a plurality of intersecting sides thereby facilitating said chuck to grip said drive shaft when said coupling end is inserted into said chuck, said chuck rotating said drive shaft in said first direction or said second direction when said motor is turned on.

6. The assembly according to claim 4, wherein said drive unit includes:

a drive gear being coupled to said drive end of said drive shaft; and a ring gear being rotatably positioned within said housing, said ring gear having a top surface and an inwardly facing surface, said top surface having a plurality of grooves therein to define a plurality of teeth, said drive gear engaging said teeth on said top surface, said ring gear surrounding said opening in said housing having said inwardly facing surface being exposed in said opening wherein said ring gear is configured to engage the threaded fastener.

7. The assembly according to claim 6, wherein said inwardly facing surface of said ring gear has a plurality of indentations therein wherein said inwardly facing surface is configured to engage respective sides of a head on the threaded fastener, said ring gear being rotated about an axis being oriented perpendicular to said longitudinal axis of said power tool, said ring gear defining said socket in said drive unit.

8. A powered socket wrench assembly being configured to apply torque to a threaded fastener for tightening or loosening the threaded fastener, said assembly comprising:

a power tool having a back end and a front end, said power tool being elongated along a longitudinal axis extending between said back end and said front end wherein said power tool is configured to be inserted into a hard to reach area, said power tool including a motor, a chuck being rotatably coupled to said motor, a forward switch and a reverse switch, said motor rotating in a first direction when said forward switch is engaged and said motor is turned on, said motor rotating in a second direction when said reverse switch is engaged and said motor is turned on;

a drive unit being insertable into said chuck on said power tool thereby facilitating said power tool to rotate said drive unit when said power tool is turned on, said drive unit including a socket being rotatable about an axis being oriented perpendicular to said longitudinal axis of said power tool when said power tool is turned on, said drive unit comprising:

a housing having a rear end, a front end, a top surface and a bottom surface, said housing curving outwardly adjacent to said front end such that said front end has a circular cross section taken along a line extending through said top surface and said bottom surface, said housing having an opening extending through said top surface and said bottom surface, said opening being positioned adjacent to said front end, said opening having a bounding surface being continuously arcuate about a center point of said opening such that said opening has a circular shape;

a drive shaft having a drive end and a coupling end, said drive shaft extending into said housing having said coupling end being exposed and having said drive end being positioned within said housing, said coupling end having an outer surface, said outer surface having a plurality of intersecting sides thereby facilitating said chuck to grip said drive shaft when said coupling end is inserted into said chuck, said chuck rotating said drive shall in said first direction or said second direction when said motor is turned on;

a drive gear being coupled to said drive end of said drive shall; and a ring gear being rotatably positioned within said housing, said ring gear having a top surface and an inwardly facing surface, said top surface having a plurality of grooves therein to define a plurality of teeth, said drive gear engaging said teeth on said top surface, said ring gear surrounding said opening in said housing having said inwardly facing surface being exposed in said opening wherein said ring gear is configured to engage the threaded fastener, said inwardly facing surface of said ring gear having a plurality of indentations therein wherein said inwardly facing surface is configured to engage respective sides of a head on the threaded fastener, said ring gear being rotated about an axis being oriented perpendicular to said longitudinal axis of said power tool, said ring gear defining said socket in said drive unit; and a handle being releasably attachable to said drive unit wherein said handle is configured to enhance gripping said drive unit, said handle including an engagement being movably coupled to said handle, said engagement comprising a first jaw that is slidable toward or away from a second jaw, said engagement releasably engaging said drive unit thereby facilitating said handle to extend along an axis being oriented perpendicular to said longitudinal axis of said power tool.

* * * * *